US009013736B2

(12) United States Patent
Murayama

(10) Patent No.: US 9,013,736 B2
(45) **Date of Patent: *Apr. 21, 2015**

(54) IMAGE FORMING APPARATUS HAVING A TAG READER WITH READING RANGE CHANGED BY A COVER POSITION

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 632 days.

This patent is subject to a terminal disclaimer.

(21) Appl. No.: 12/892,243

(22) Filed: Sep. 28, 2010

(65) Prior Publication Data

US 2011/0075214 A1 Mar. 31, 2011

(30) Foreign Application Priority Data

Sep. 29, 2009 (JP) ..... 2009-224548

(51) Int. Cl.

| | |
|---|---|
| ***G06F 3/12*** | (2006.01) |
| ***G03G 15/00*** | (2006.01) |
| ***G03G 15/10*** | (2006.01) |
| ***G03G 21/18*** | (2006.01) |
| ***G03G 15/08*** | (2006.01) |

(52) U.S. Cl.

CPC .... *G03G 21/1882* (2013.01); *G03G 2215/0695* (2013.01); *G03G 15/0863* (2013.01)

(58) Field of Classification Search

None

See application file for complete search history.

(56) References Cited

U.S. PATENT DOCUMENTS

| | | | | |
|---|---|---|---|---|
| 6,654,567 | B2 | 11/2003 | Karakama | |
| 7,140,713 | B2 | 11/2006 | Kawakami | |
| 7,433,610 | B2 | 10/2008 | Oyama | |
| 7,941,061 | B2 | 5/2011 | Kadowaki | |
| 2002/0031359 | A1 | 3/2002 | Karakama | |
| 2004/0239706 | A1 | 12/2004 | Kawakami | |
| 2006/0219770 | A1 | 10/2006 | Oyama | |
| 2006/0227693 | A1* | 10/2006 | Park et al. | 369/112.05 |
| 2007/0080786 | A1 | 4/2007 | Kusumi | |
| 2008/0192451 | A1* | 8/2008 | Sinnett et al. | 361/776 |
| 2008/0283596 | A1 | 11/2008 | Ishida | |
| 2008/0317479 | A1 | 12/2008 | Kadowaki | |
| 2009/0216536 | A1* | 8/2009 | Matsuhara et al. | 704/260 |

FOREIGN PATENT DOCUMENTS

| | | | |
|---|---|---|---|
| JP | 2002072824 | A | 3/2002 |
| JP | 2002-127391 | A | 5/2002 |
| JP | 2002-331686 | | 11/2002 |
| JP | 2003159808 | A | 6/2003 |
| JP | 2004142379 | A | 5/2004 |
| JP | 2004326125 | A | 11/2004 |
| JP | 2005004230 | A | 1/2005 |
| JP | 2005257816 | A | 9/2005 |
| JP | 2006018396 | A | 1/2006 |

(Continued)

OTHER PUBLICATIONS

JP2007047505—translation, Okabe, Feb. 22, 2007.*

(Continued)

*Primary Examiner* — Fan Zhang

(74) *Attorney, Agent, or Firm* — Banner & Witcoff, Ltd.

(57) ABSTRACT

A system and method for tracking consumables associated with an image forming device is described. An RFID reader is positioned to read RFID tags associated with the consumables when the consumables are inserted into, stationary in, or removed from the image forming device.

20 Claims, 11 Drawing Sheets

(56) References Cited

FOREIGN PATENT DOCUMENTS

| | | | |
|---|---|---|---|
| JP | 2006-084984 | | 3/2006 |
| JP | 2006-098895 | | 4/2006 |
| JP | 2006201381 | A | 8/2006 |
| JP | 2006285124 | A | 10/2006 |
| JP | 2007-047505 | A | 2/2007 |
| JP | 2007-098840 | | 4/2007 |
| JP | 2007240575 | A | 9/2007 |
| JP | 2007264041 | A | 10/2007 |
| JP | 2007272130 | A | 10/2007 |
| JP | 2009-014991 | | 1/2009 |
| JP | 2009003099 | A | 1/2009 |
| JP | 2009015106 | A | 1/2009 |
| JP | 2009163274 | A | 7/2009 |
| WO | 2006-090554 | | 8/2006 |

OTHER PUBLICATIONS

JP Notice of Reasons for Rejection dated Aug. 16, 2011, corresponding Application No. 2009-224548; English Translation.

Decision to Grant a Patent for Japanese patent application No. 2009-224663 mailed Aug. 16, 2011.

Decision to Grant a Patent for Japanese patent application No. 2009-224548 mailed Mar. 13, 2012.

* cited by examiner

IMAGE FORMING APPARATUS HAVING A TAG READER WITH READING RANGE CHANGED BY A COVER POSITION

CROSS REFERENCE TO RELATED APPLICATION

This application claims priority from Japanese Patent Application No. 2009-224548, filed on Sep. 29, 2009, the entire subject matter of which is incorporated herein by reference.

FIELD

Aspects of the disclosure relate to an image forming apparatus including a reading portion that is configured to read information from a wireless tag attached to a consumable unit.

BACKGROUND

A known image forming apparatus, e.g., an inkjet printer, is configured to read information from a wireless tag attached to an ink cartridge. Based on the information read from the wireless tag, the image forming apparatus determines a manufacturer of the instant ink cartridge for consumables management.

Another known image forming apparatus, e.g., a laser printer, includes an accommodating unit, e.g. a drawer, to accommodate a plurality of consumable units, e.g. consumable cartridges, which are detachable. The accommodating unit may be slidable from a predetermined position inside the printer to outside the printer. When the accommodating unit is slid outside the printer, the user can replace a cartridge with a new one.

Even in the image forming apparatus having such an accommodating unit, a wireless tag may be attached to each cartridge for consumables management. In this case, a reading portion that reads information from the wireless tag is required to have a high degree of accuracy of reading in consideration of that each cartridge accommodated in the accommodating unit moves in accordance with movement of the accommodating unit.

SUMMARY

Aspects of the disclosure provide an image forming apparatus including a reading portion that reads information from a wireless tag attached to a consumable unit, wherein the image forming apparatus has a high degree of accuracy of reading with an inexpensive structure even if consumable units accommodated in an accommodating unit move in accordance with movement of the accommodating unit.

BRIEF DESCRIPTION OF THE DRAWINGS

Illustrative aspects will be described in detail with reference to the following figures in which like elements are labeled with like numbers and in which.

DETAILED DESCRIPTION

Figure 1:
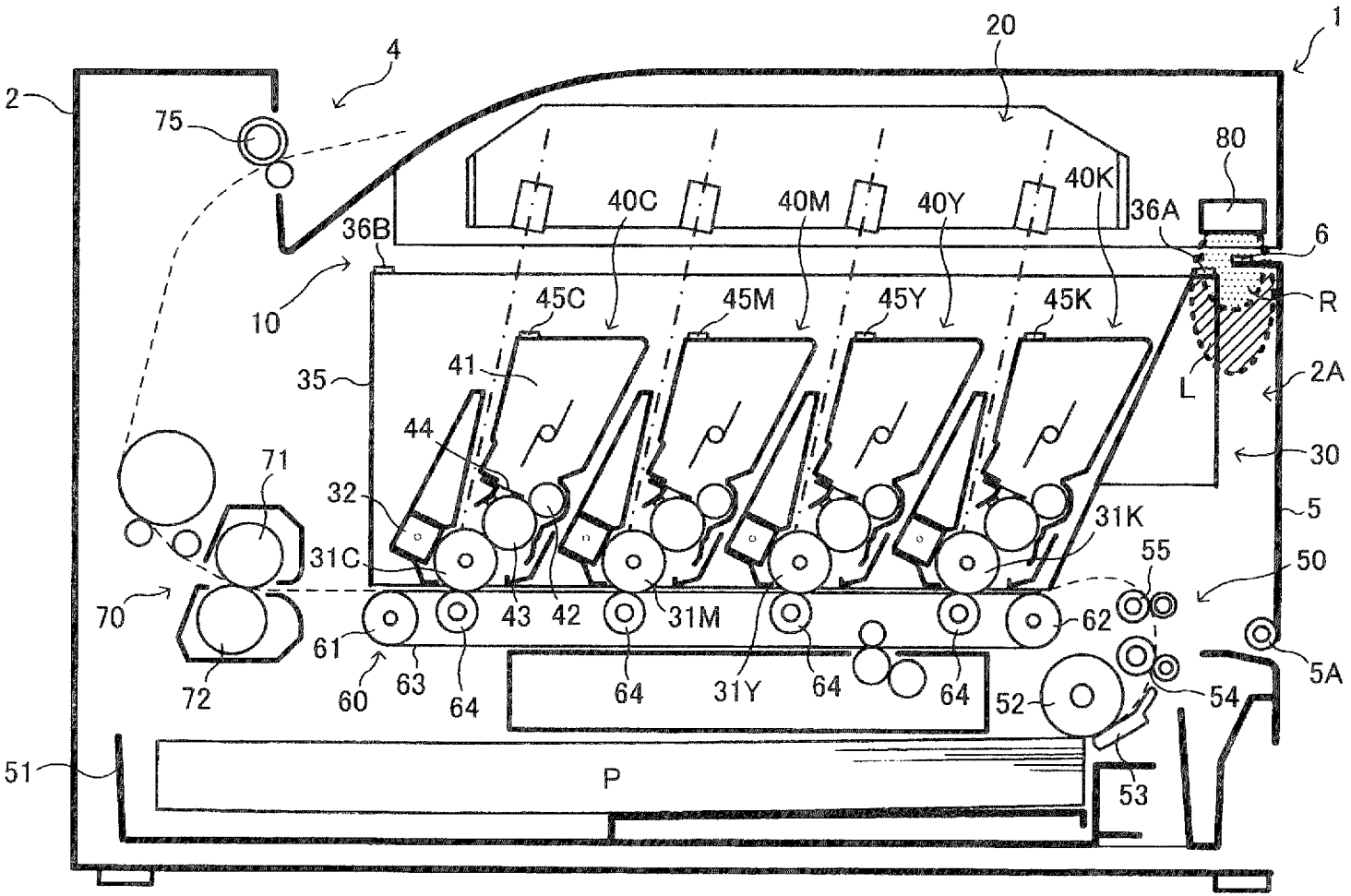
FIG. 1 is a side sectional view of an internal structure of a laser printer as an illustrative example of an image forming apparatus using features described herein.

A first illustrative embodiment will be described in detail with reference to the accompanying drawings. An image forming apparatus according to aspects of the disclosure applies to a laser printer 1 as shown in FIG. 1. The laser printer 1 is an electrophotographic color laser printer that forms a color image on a recording sheet P. The recording sheet may include plain paper, cardboards, postcards, and transparency sheets.

For ease of discussion, in the following description, the "top" or "upper side", the "bottom" or "lower side", the "left" or "left side", the "right" or "right side", the "front" or "front side", and the "rear" or "rear side" are used to define the various parts when the laser printer 1 is disposed in an orientation in which it is intended to be used. In FIG. 1, the right side is referred to as the front or front side, the left side is referred to as the rear or the rear side, the upper side is referred to as the top or upper side, the down side is referred to as the bottom or lower side, and an up and down direction is referred to as a top-bottom direction or vertical direction.

Figure 4:
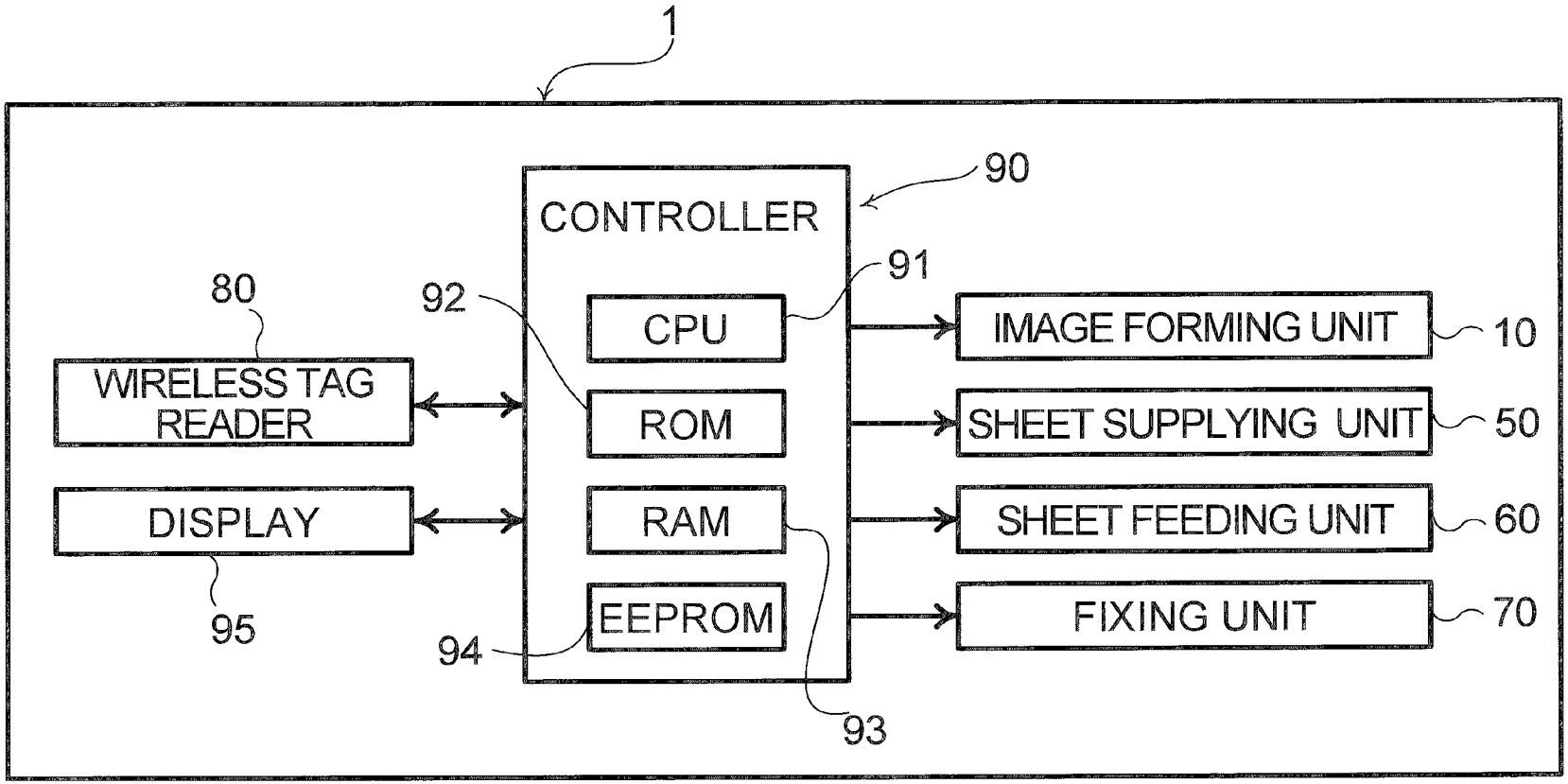
FIG. 4 is a block diagram illustrating a control system of a laser printer.

As shown in FIG. 1, the laser printer 1 may include a generally box-shaped main body 2. A front side of the main body 2 contains an opening 2A. The main body 2 accommodates an image forming unit 10, a sheet supplying unit 50, a sheet feeding unit 60, a fixing unit 70, an wireless tag reader 80, and a controller 90 (FIG. 4).

The main body 2 includes a frame member (not shown) inside. The image forming unit 10, the sheet supplying unit 50, the sheet feeding unit 60, and the fixing unit 70 are assembled to the frame member. The frame member includes a pair of side frames along right and left side surfaces of the main body 2. The side frames support a drawer case 35 such that the drawer case 35 slidably moves in the front-rear direction.

A top surface of the main body 2 contains an output tray 4 and a display 95. The output tray 4 is configured to store recording sheets 4 each having an image thereon such that they are overlaid, one over the other. The display 95 is configured to display various information, e.g. an error message relating to image formation, based on the controller 90.

Figure 6:
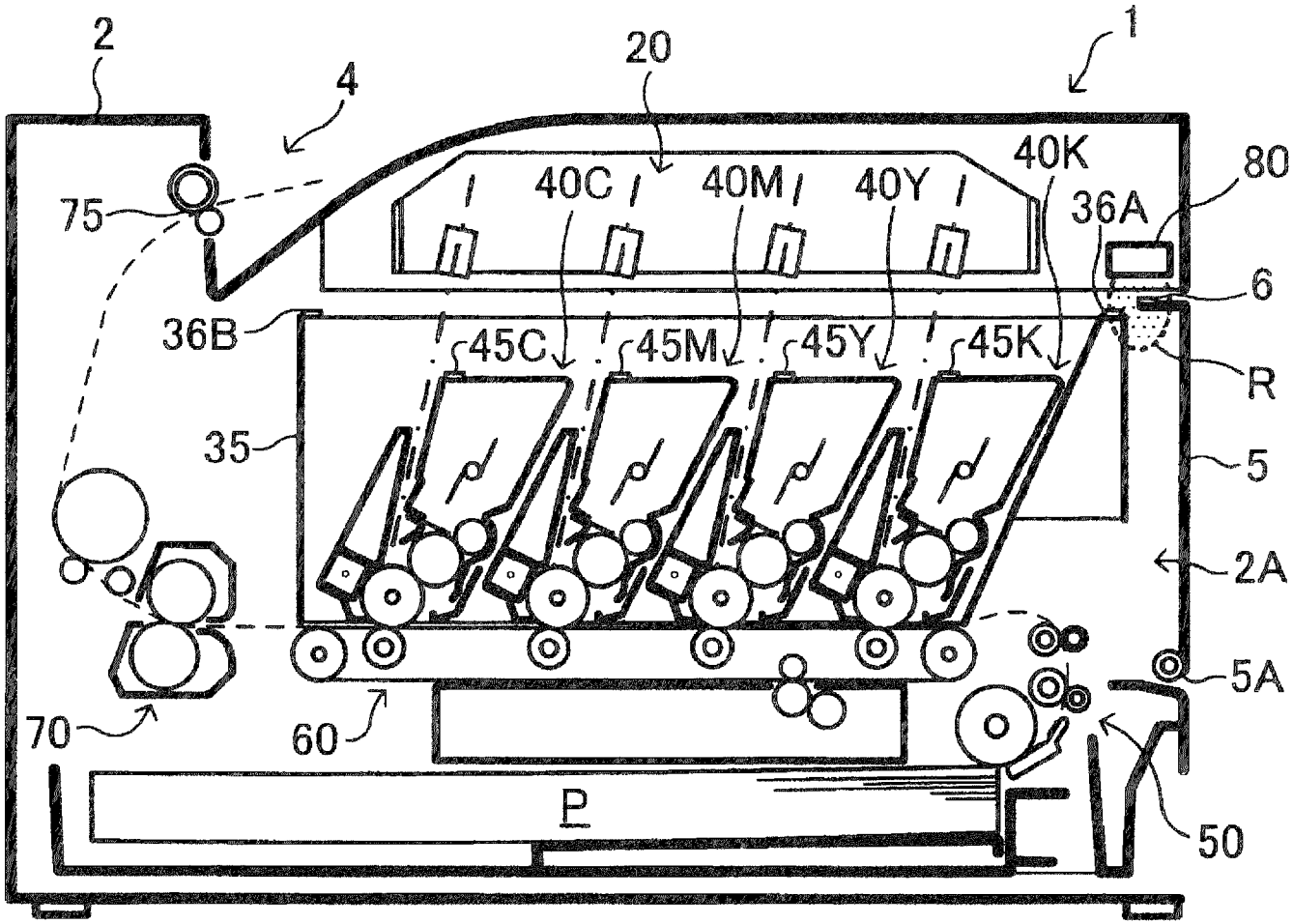
FIG. 6 is a side sectional view of the laser printer for process cartridge replacement.
Figure 7:
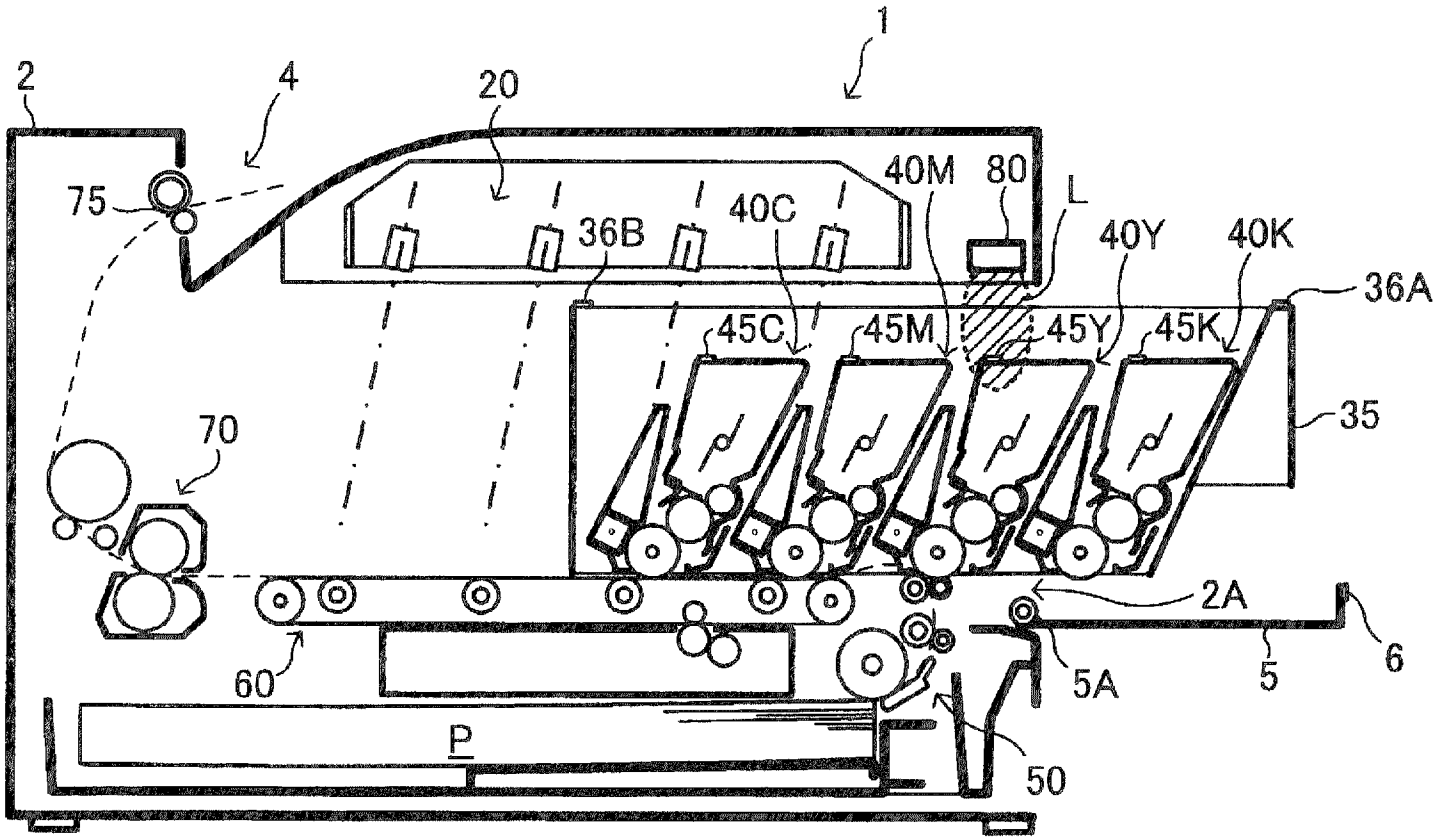
FIG. 7 is a side sectional view of the laser printer for process cartridge replacement.
Figure 8:
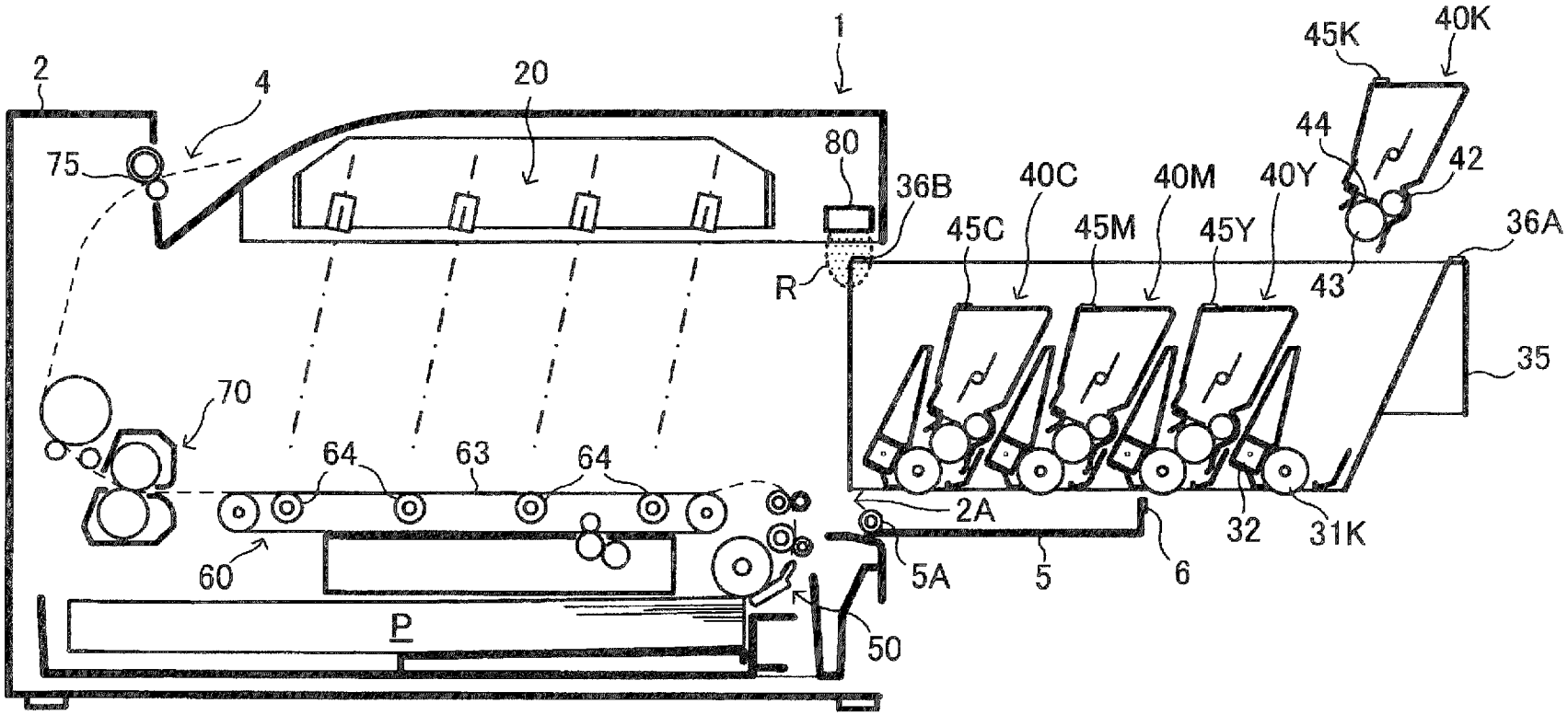
FIG. 8 is a side sectional view of the laser printer for process cartridge replacement.

The front side of the main body 2 contains a front cover 5 which opens and closes the opening 2 as shown in FIGS. 6-8. Specifically the front cover 5 is pivotally supported by the main body 2 in such a manner as to pivot on a shaft 5A which is disposed at a lower end defining the opening 2A. The front cover 5 is movable between a closed position in which the opening 2A is closed (FIG. 6) and an open position in which the opening 2A is open (FIG. 8).

The front cover 5 includes a cover tag 6 in a predetermined position of an end opposite to the shaft 5A. The cover tag 6 is disposed above the drawer case 35 when the front cover 5 is in the closed position. The cover tag 6 is a wireless tag, e.g. a passive radio frequency identification (RFID) tag, which may be configured to receive radio waves from the wireless tag reader 80 as its operating power. The cover tag 6 stores various kinds of information specific thereto, such as identification information.

The main body 2 accommodates the wireless tag reader 80 slightly above an upper end defining the opening 2A. When the front cover 5 is placed in the closed position as shown in FIG. 1, the wireless tag reader 80 is disposed above the cover tag 6. The wireless tag reader 80 is located in a central portion with respect to a width direction that is a right-left direction of the main body 2 or the front door 5 placed in the closed position. The wireless tag reader 80 has a reading range having a directivity directed downward to a center of the opening 2A, e.g. a first reading range R and a second reading range L as shown in FIG. 1.

The wireless tag reader 80 is configured to read information from wireless tags, e.g. passive RFID tags, which are located within the reading range, e.g. the cover tag 6, a first drawer tag 36A, a second drawer tag 36B, and a cartridge tag 45. Specifically, the wireless tag reader 80 emits radio waves including a command toward a wireless tag. The wireless tag responds by emitting radio waves, and the wireless tag reader 80 reads information stored in the wireless tag by receiving and decoding the radio waves received from the wireless tag. The reading range means a range in which the wireless tag reader 80 transmits and receives radio waves to and from the wireless tag. The wireless tag reader 80 is connected to an auxiliary power supply of the laser printer 1, and is capable of reading the wireless tag even when the laser printer 1 is not in operation.

The image forming unit 10 of the laser printer 1 will be described.

The image forming unit 10 is located in substantially a central portion inside the main body 2 and is configured to form an image on a recording sheet P. The image forming unit 10 includes a scanner unit 20 and a photosensitive member unit 30.

The scanner unit 20 is disposed in the top portion within the main body 2 and includes laser light sources, a polygon mirror, fθ lenses, and reflecting mirrors. The scanner unit 20 has, e.g. four, laser light sources, which are provided for a plurality of colors, e.g. four colors of black, yellow, magenta, and cyan. A laser beam emitted from each laser light source, based on image data, may be deflected by the polygon mirror, pass through the fθ lenses, and be folded by the reflecting mirror to be directed to a surface of each photosensitive drum 31, on which an electrical latent image is formed. The electrical latent image formed on each photosensitive drum 31 is to be developed with one of black, yellow, magenta, and cyan.

The photosensitive member unit 30 is disposed below the scanner unit 20 and above the sheet feeding unit 60. The photosensitive member unit 30 includes process cartridges 40, photosensitive drums 31, and chargers 32, which all are provided for a plurality of colors, e.g., four colors of black, yellow, magenta, and cyan. The photosensitive member unit 30 further includes the drawer case 35. The drawer case 35 holds four process cartridges 40 arranged in tandem in the front-rear direction. Process cartridges 40 are one type of consumable product (hereinafter "consumables"). Photosensitive drums 31 may also be considered a consumable.

As shown in FIGS. 6-8, the drawer case 35 is slidable along guides formed on the frame member in the front-rear direction of the laser printer 1. The drawer case 35 is movable between a use position shown in FIG. 6 and a replacement position shown in FIG. 8 in the front-rear direction. As shown in FIGS. 1 and 6, when the drawer case 35 is in the use position or located in the main body 2A, image is formed using the process cartridges 40. As shown in FIG. 8, when the drawer case 35 is in the replacement position or located outside the main body 2A, the process cartridges 40 can be attached to or removed from the drawer case 35 for replacement.

As shown in FIG. 1, each process cartridge 40 includes a toner chamber 41, a supply roller 42, a developing roller 43, a layer-thickness regulating blade 44, and a cartridge tag 45. Each process cartridge 40 is configured to be attached to and removed from the drawer case 35, independently. The toner chamber 41 forms an upper portion of the process cartridge 40, and is configured to store black, yellow, magenta, or cyan toner. The supply roller 42 is configured to supply toner in the toner chamber 41 to a surface of the developing roller 43. The developing roller 43 is configured to supply the toner supplied from the supply roller 42 to a surface of the photosensitive drum 31. The layer-thickness regulating blade 44 is configured to regulate the toner carried on the surface of the developing roller 43 to a uniform thickness.

The four process cartridges 40 are provided for colors of toner stored in the toner chamber 41: black, yellow, magenta, and cyan. In the first illustrative embodiment, the process cartridges 40 are attached to the drawer case 35 such that a first process cartridge 40K storing black toner, a second process cartridge 40Y storing yellow toner, a third process cartridge 40M storing magenta toner, and a fourth process cartridge 40C storing cyan toner are arranged in this order from front to rear of the laser printer 1.

Figure 3:
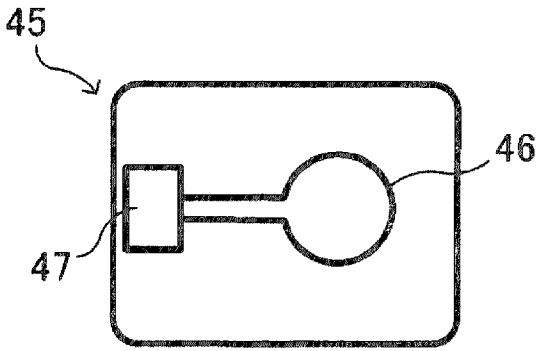
FIG. 3 illustrates a structure of a cartridge tag according to the first illustrative embodiment.

Each process cartridge 40 includes its corresponding cartridge tag 45 on the top surface thereof. The cartridge tag 45 is a wireless tag, e.g. a passive RFID tag, which includes an antenna 46 and an IC chip 47 (FIG. 3). The cartridge tag 45 stores identification information.

The drawer case 35 includes four photosensitive drums 31 and four chargers 32. Each photosensitive drum 31 is rotatably supported below the corresponding process cartridge 40 and is disposed such as to contact a conveying belt 63 of the sheet feeding unit 60. Each charger 32 is a scorotron charger and is disposed in a position facing the corresponding photosensitive drum 31. The charger 32 is configured to positively charge the surface of the photosensitive drum 31 to form an electrostatic latent image on the photosensitive drum 31.

In the first illustrative embodiment, as is the case with the process cartridges 40, the four photosensitive drums 31 includes a first photosensitive drum 31K corresponding to black toner, a second photosensitive drum 31Y corresponding to yellow toner, a third photosensitive drum 31M corresponding to magenta toner, and a fourth photosensitive drum 31C corresponding to cyan toner, which are arranged in this order from front to rear of the laser printer 1.

Figure 2:
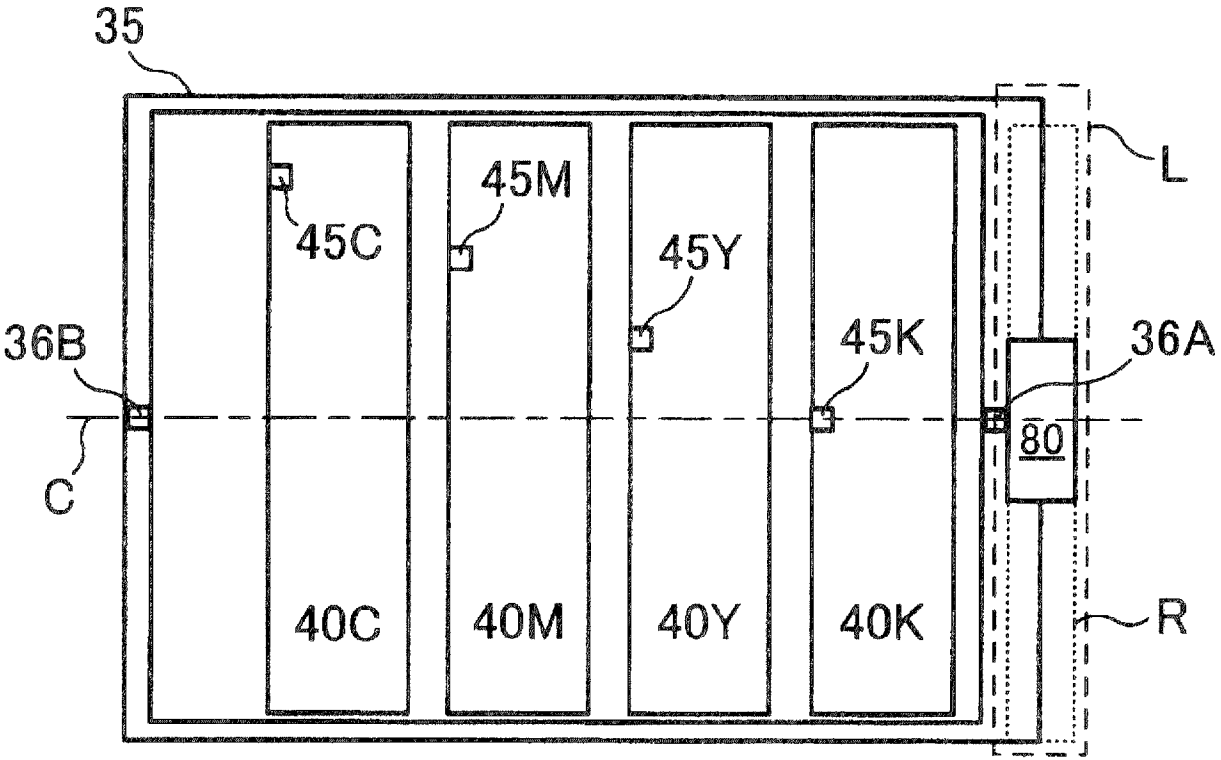
FIG. 2 is a top view schematically illustrating arrangement of cartridge tags according to a first illustrative embodiment.

The drawer case 35 further includes a first drawer tag 36A and a second drawer tag 36B, which are wireless tags, e.g. passive RFID tags, and store identification information respectively. In the drawer case 35, the first drawer tag 36A and the second drawer tag 36B are disposed above the cartridge tags 45. The first drawer tag 36A is disposed in a front upper end portion of the drawer case 35 and the second drawer tag 36B is disposed in a rear upper end portion of the drawer case 35. As shown in FIG. 2, the first and second drawer tags 36A, 36B are disposed on a centerline C of the drawer case 35 in the width direction. The first and second drawer tags 36A, 36B pass under the wireless tag reader 80 as the drawer case 35 moves as shown in FIGS. 6-8.

The sheet supplying unit 50 of the laser printer 1 will be described.

The sheet supplying unit 50 includes a sheet supply tray 51, a sheet supply roller 52, a separation pad 53, a pair of feed rollers 54, and a pair of registration rollers 55.

The sheet supply tray 51 is configured to store a stack of recording sheets P and is disposed in a lower portion of the main body 2. The sheet supply cassette 51 may be configured to be attached to and removed from the front of the main body 2. The pick up roller 52 is rotatably disposed in a front upper portion of the sheet supply cassette 51 and configured to pick up sheets P in the sheet supply tray 51 and feed them toward the image forming unit 10. The separation pad 53 is configured to separate the sheets P picked up by the pickup roller 52 one by one. The feed rollers 54 are disposed downstream of the separation pad 53 in a sheet feeding direction, and configured to contact the sheet P separated by the separation pad 53 and feed it to the image forming unit 10. The registration rollers 55 are disposed at a downstream side from the feed rollers 54 in the sheet feeding direction and configured to contact the leading edge of the recording sheet P, correct skew of the recording sheet P and feed it further to the image forming unit 10.

The sheet feeding unit 60 of the laser printer 1 will be described.

The sheet feeding unit 60 is disposed below the image forming unit 10 and above the sheet supply tray 51. The sheet feeding unit 60 is configured to feed the recording sheet P supplied by the sheet supplying unit 50 toward the fixing unit 70. The sheet feeding unit 60 includes a drive roller 61, a driven roller 62, the conveying belt 63 and four transfer rollers 64.

The driven roller 61 and the driven roller 62 are spaced apart in the front-rear direction and parallel to each other under the image forming unit 10. The conveying belt 63 is an endless belt made of a conductive rubber and is stretched around the drive roller 61 and the driven roller 62. Thus, the conveying belt 63 rotates along with rotation of the drive roller 61. The upper surface of the conveying belt 63 contacts the photosensitive drums 31. The transfer rollers 64 are disposed within the conveying belt 63 and under the respective photosensitive drums 31 such that the conveying belt 63 is sandwiched between the transfer rollers 64 and the photosensitive drums 31.

The fixing unit 70 of the laser printer 1 will be described.

The fixing unit 70 is disposed behind the image forming unit 10. The fixing unit 70 includes a heat roller 71 and a pressure roller 72. The heat roller 71 is configured to feed the recording sheet P toward the output tray 4 disposed downstream in the sheet feeding direction, while heating toner transferred onto the recording sheet P. The pressure roller 72 is disposed facing the heat roller 71 and configured to rotate while pressing the recording sheet P toward the heat roller 71. Thus, the fixing unit 70 is configured to melt the toner transferred onto the recording sheet P by heat and fix it to the recording sheet P, while feeding the recording sheet P toward the output tray 4.

An ejection roller 75 is disposed upward from the fixing unit 70 such as to rotate along a rear end of the output tray 4. The ejection roller 75 is configured to eject the recording sheet P fed by the fixing unit 70 to the output tray 4.

In the printer 1, an image is formed on a recording sheet P as follows.

When the image formation starts, the sheet supplying unit 50 and the sheet feeding unit 60 operate to feed a recording sheet P from the sheet supply tray 51 to the image forming unit 10. During this time, the surfaces of the rotating photosensitive drums 31K, 31Y, 31M and 31C are uniformly and positively charged by the respective chargers 32, and exposed to laser beams emitted from the scanner unit 20, so that latent images based on image data are formed on the surfaces of the photosensitive drums 31K, 31Y, 31M and 31C.

In each of the process cartridges 40K, 40Y, 40M, and 40C, toner in the toner chamber 41 is supplied through the supply roller 42 and the developing roller 43 to the surface of the corresponding one of the photosensitive drums 31K, 31Y, 31M and 31C. As a result, the electrostatic latent image formed on the surface of each photosensitive drum 31 becomes visible and a reversal takes place. In this manner, toner images are carried on the surfaces of the photosensitive drums 31K, 31Y, 31M and 31C.

The toner images carried on the surfaces of the photosensitive drums 31 are transferred onto a recording sheet P, which is fed along the surface of the conveying belt 63 from front to rear, by a voltage applied to the transfer rollers 64. When the recording sheet P having toner images is fed to the fixing unit 70, the fixing unit 70 melts toner by the application of heat, so that the toner images are fixed onto the recording sheet P as an image. The recording sheet P having the image is fed upward from the fixing unit 70 and ejected to the output tray 4.

The cartridge tags 45 attached to the process cartridges 40 will be described.

As described above, each of the process cartridges 40K, 40Y, 40M, and 40C includes one cartridge tag 45. In the following description, a cartridge tag 45 attached to the first process cartridge 40K is referred to as a first cartridge tag 45K, a cartridge tag 45 attached to the second process cartridge 40Y is referred to as a second cartridge tag 45Y, a cartridge tag 45 attached to the third process cartridge 40M is referred to as a third cartridge tag 45M, and a cartridge tag 45 attached to the fourth process cartridge 40C is referred to as a fourth cartridge tag 45C.

As shown in FIG. 2, the first cartridge tag 45K is disposed on the centerline C of the drawer case 35 in the width direction on the top surface of the first process cartridge 40K. Thus, the first cartridge tag 45K passes under the wireless tag reader 80 when the drawer case 35 moves between the use position and the replacement position.

The second, third and fourth cartridge tags 45Y, 45M, 45C are positioned on the top surfaces of the second, third and fourth process cartridges 40Y, 40M, 40C such as to be gradually spaced away from the centerline C in the width direction. Of the second, third and fourth cartridge tags 45Y, 45M, 45C, the second cartridge tag 45Y is disposed closest to the center line C and the fourth cartridge tag 45C is disposed farthest from the centerline C. When the drawer case 35 moves between the use position and the replacement position, the second, third and fourth cartridge tags 45Y, 45M, 45C pass within the reading range of the wireless tag reader 80, which is directed downward.

As each cartridge tag 45 has a different distance to the centerline C, the distance from the centerline C to each cartridge tag 45 passing under the wireless tag reader 80 becomes longer in this order: the first cartridge tag 45K, the second cartridge tag 45Y, the third cartridge tag 45M, and the fourth cartridge tag 45C.

Each cartridge tag 45 has an antenna 46 and an integrated circuit (IC) chip 47. In the first illustrative embodiment, the first to fourth cartridge tags 45K, 45Y, 45M, 45C are identical in shape and structure.

In the cartridge tag 45 according to the first illustrative embodiment, the antenna 46 is a loop antenna that is configured to allow the cartridge tag 45 to transmit and receive radio waves to and from the wireless tag reader 80. When the antenna 46 receives radio waves including a command, it creates electromotive force by resonance. The IC chip 47 energizes the circuits by the electromotive force, and reads information stored in the cartridge tag 45. The IC chip 47 transmits the read information to the wireless tag reader 80 via the antenna 46. The IC chip 47 stores identification information specific to the cartridge tag 45 and information specific to the corresponding process cartridge 40. The information specific to the process cartridge 40 includes a date of manufacture of the process cartridge 40 and a manufacturer, and is written in the IC chip 47 when the cartridge tag 45 is attached to the process cartridge 40.

As described above, the wireless tag reader 80 reads information stored in the wireless tag by transmitting and receiving radio waves to and from the wireless tag. As each cartridge tag 45 is positioned at a different distance to the centerline C and the antenna 46 of each cartridge tag 45 is identical in configuration, a radio wave transmitted from each cartridge tag 45 arrives at the wireless tag reader 80 at a different intensity. Thus, the wireless tag reader 80 can identify each of the first to fourth cartridge tags 45K, 45Y, 45M, 45C from the received radio wave intensities.

A control system of the laser printer 1 will be described.

Figure 9:
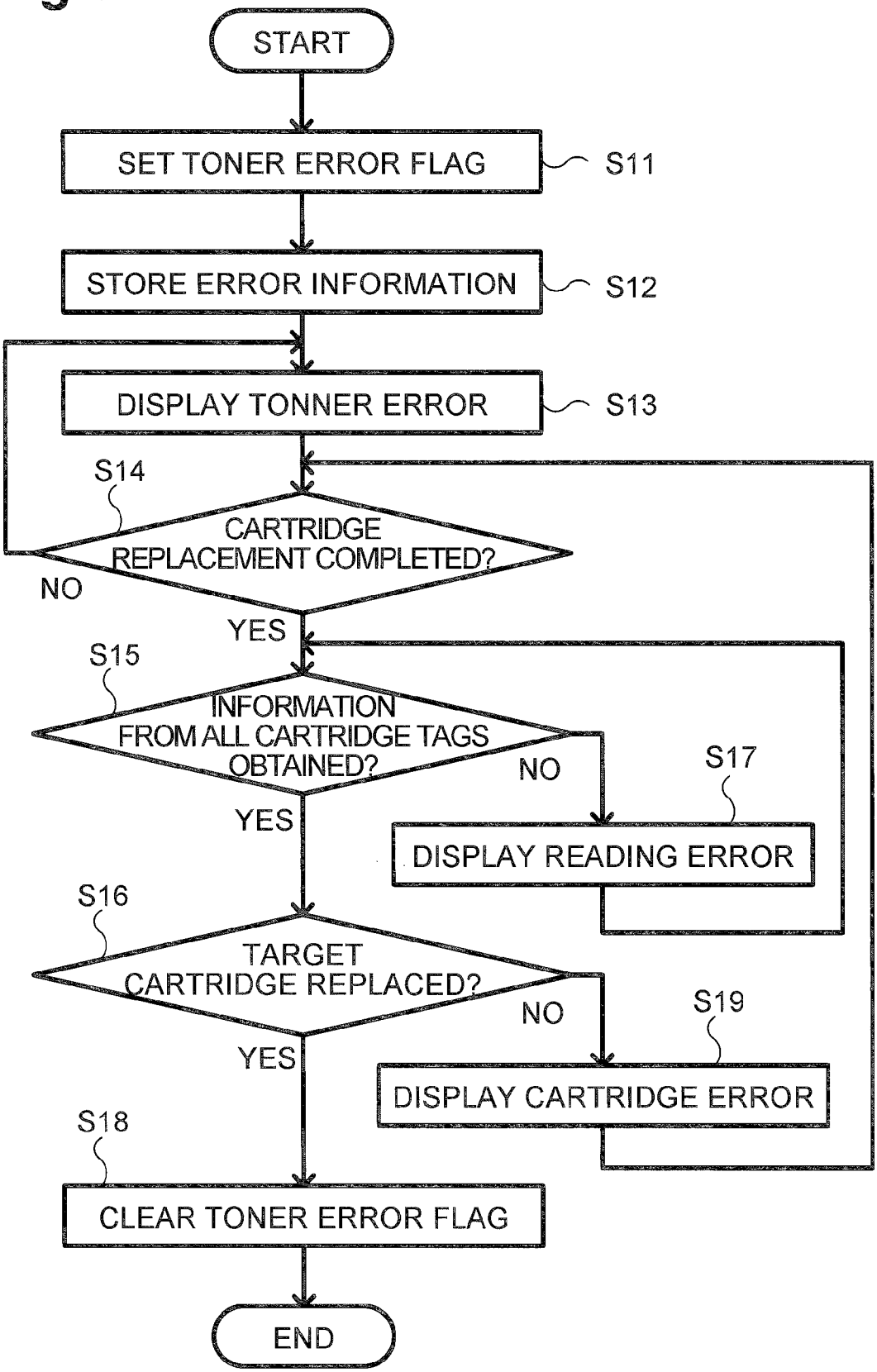
FIG. 9 is a flowchart of a toner error handling program.

As shown in FIG. 4, the laser printer 1 includes a controller 90. The controller 90 is made up of a central process unit (CPU) 91, a read-only memory (ROM) 92, a random access memory (RAM) 93, and an electrically erasable programmable read only memory (EEPROM) 94. The CPU 91 is the core part that controls all the data relating to the laser printer 1, and performs control programs, e.g., a reading range setting program (FIG. 5), and a toner error handling program (FIG. 9). The ROM 92 stores the control programs and data tables required for controlling the laser printer 1. The reading range setting program and the toner error handling program are stored in the ROM 92. The RAM 93 is a volatile memory that temporarily stores computation results by the CPU 91.

The EEPROM 94 is a non-volatile memory that stores data, e.g. user configuration settings, relating to image formation of the laser printer 1. Specifically, the EEPROM 94 stores identification information read from the cartridge tags 45, and the number of pages which have been output since each process cartridge 40 was attached. In addition, the EEPROM 94 may store error information for each identification information based on the toner error handling program.

The controller 90 is connected to the wireless tag reader 80. Thus, the controller 90 may process information read by the wireless tag reader 80 based on the control programs. For example, the controller 90 may allow the EEPROM 94 to store information of the cartridge tags 45 read by the wireless tag reader 80 by identification information.

The controller 90 is also connected to the display 95. Thus, the controller 90 may allow the display 95 to display various messages in accordance with the control programs. For example, the controller 90 may display various error messages on the display 95 in accordance with the toner error handling program (e.g. S13, S17, and S19 in FIG. 9).

The controller 90 is further connected to the image forming unit 10, the sheet supplying unit 50, the sheet feeding unit 60, and the fixing unit 70. Thus, the controller 90 controls the image forming unit 10 to form an image on a recording sheet P based on print data.

Replacement of the process cartridge 40 will be described with reference to FIGS. 6-8.

When the laser printer 1 is in normal operation or in a state where image formation is normally performed, the drawer case 35 holding the four process cartridges 40 is placed in the use position, and the front cover 5 is placed in the closed position (FIGS. 1 and 6). In this case, the cover tag 6 and the first drawer tag 36A are positioned within the first reading range R of the wireless tag reader 80, and located above the cartridge tags 45 or closer to the wireless tag reader 80 than the cartridge tags 45 (FIGS. 1, 6, and 8). That is, the laser printer 1 is detecting the cover tag 6 and the first drawer tag 36A when in normal operation.

When a process cartridge 40 is replaced because of, e.g. toner exhaustion, the front cover 5 is moved from the closed position to the open position (FIGS. 6 and 7). When the front cover 5 is moved to the open position, the cover tag 6 moves outside of the reading range of the wireless tag reader 80. Thus, when the front cover 5 is located in the open position, the wireless tag reader 80 can not detect the cover tag 6.

After the front cover 5 is moved to the open position, the drawer case 35 is moved from the use position inside the main body 2 to the front side of the laser printer 1. The drawer case 35 is slidingly moved through the opening 2A toward the replacement position (FIG. 8). At this time, the first drawer tag 36A moves outside of the reading range of the wireless tag reader 80 along with the movement of the drawer case 35 to the replacement position (FIG. 7). In other words, while the drawer case 35 is moved from the use position to the replacement position, the first drawer tag 36A changes from a state being detected by the wireless tag reader 80 (hereinafter referred to as a detected state) to a state being not detected by the wireless tag reader (hereinafter referred to as an undetected state).

When the drawer case 35 is moved from the use position to the replacement position, the first, second, third, and fourth cartridge tags 45K, 45Y, 45M, 45C pass, in this order, the second reading range L of the wireless tag reader 80 along with the movement of the drawer case 35 (FIG. 7). During the movement of the drawer case 35, the wireless tag reader 80 reads information of the first, second, third, and fourth cartridge tags 45K, 45Y, 45M, 45C in this order.

When the drawer case 35 reaches the replacement position, the second drawer tag 36B enters the first reading range R of the wireless tag reader 80 as shown in FIG. 8. The laser printer 1 can detect the drawer case 35 in the replacement position by detecting the second drawer tag 36B.

When the drawer case 35 is located in the replacement position, the process cartridges 40 can be individually removed from the drawer case 35. In the replacement position, a process cartridge 40 in which an error occurs due to, e.g., toner exhaustion, is replaced with a new process cartridge 40.

After the new process cartridge 40 is attached to the drawer case 35, the drawer case 35 is moved inside the main body 2 toward the use position. That is, the drawer case 35 is slidingly moved through the opening 2A toward the use position (FIG. 6). At this time, the second drawer tag 36B moves outside of the reading range of the wireless tag reader 80 along with the movement of the drawer case 35 to the use position (FIG. 7). When the drawer case 35 is moved from the replacement position to the use position, the second drawer tag 36B changes from the detected state to the undetected state.

When the drawer case 35 is moved from the replacement position to the use position, the fourth, third, second, and first cartridge tags 45C, 45M, 45Y, 45K pass, in this order, the second reading range L of the wireless tag reader 80 along with the movement of the drawer case 35 (FIG. 7). During the movement of the drawer case 35, the wireless tag reader 80 reads information of the fourth, third, second, and first cartridge tags 45C, 45M, 45Y, 45K in this order.

When the drawer case 35 reaches the use position, the first drawer tag 36A is located within the first reading range R of the wireless tag reader 80 (FIG. 6). Thus, the laser printer 1 can detect the drawer case 35 in the use position by detecting the first drawer tag 36A.

After the drawer case 35 is located in the use position, the front cover 5 is moved from the open position to the closed position (FIG. 6). When the front cover 5 is moved in the closed position, the cover tag 6 moves within the first reading range R of the wireless tag reader 80. Thus, when the front cover 5 is located in the closed position, the wireless tag reader 80 is capable of detecting the cover tag 6. In other words, the laser printer 1 is capable of detecting that it can normally form an image on the recording sheet P by detecting the cover tag 6. Replacement of the process cartridge 40 is finished by moving the front cover 5 to the closed position.

Figure 5:
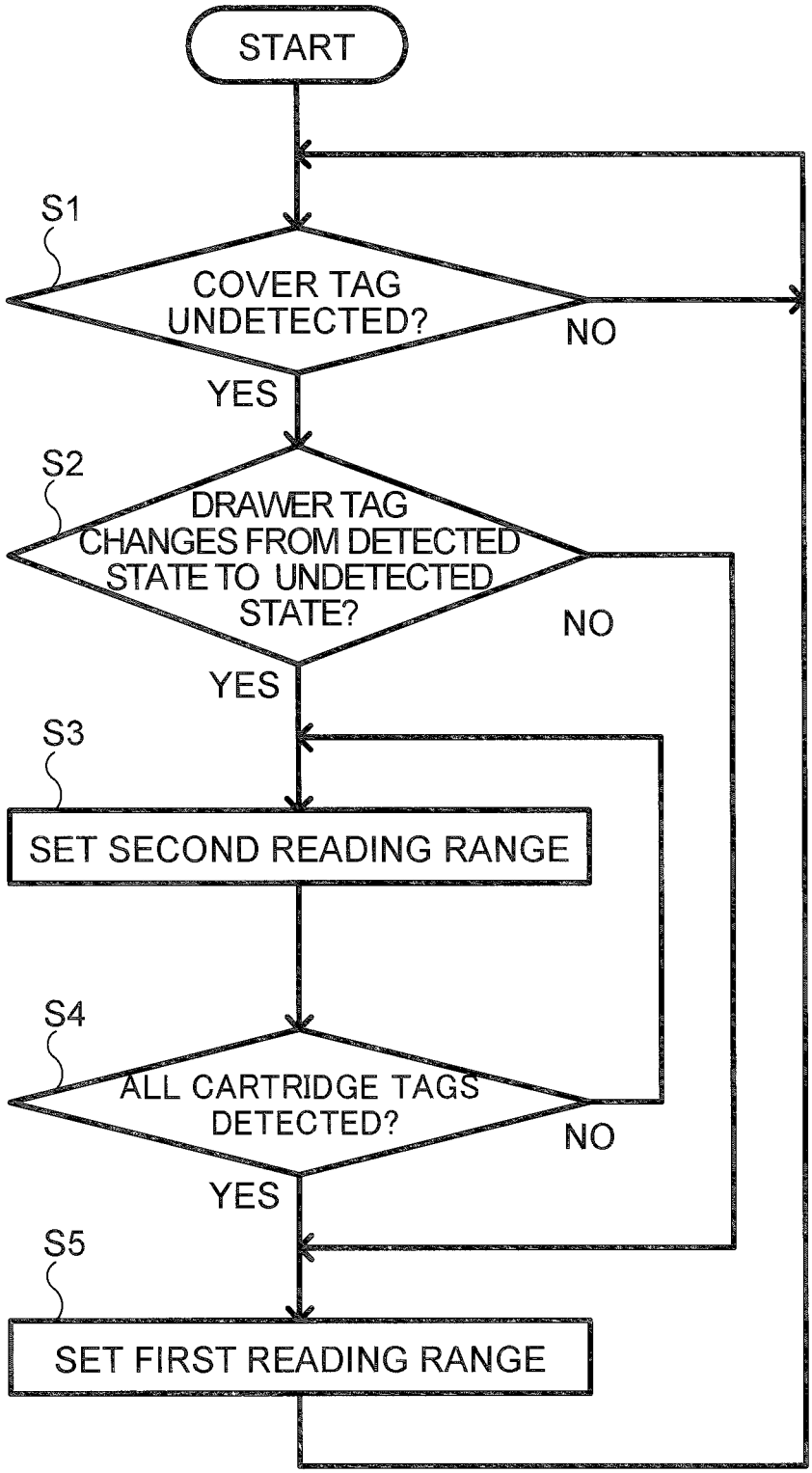
FIG. 5 is a flowchart of a reading range setting program.

The reading range setting program will be described with reference to FIG. 5.

This program is executed by the CPU 91 normally while the laser printer 1 is in operation.

In the initial state, the reading range of the wireless tag reader 80 is set to the first reading range R. As shown in FIGS. 1 and 6, the first reading range R has a directivity toward the central portion of the opening 2A, and includes the positions of the cover tag 6 and the first drawer tag 36A when the front cover 5 is in the closed position. The first reading range R does not include the positions of the cartridge tags 45 when passing through the opening 2A (FIGS. 1 and 6).

In S1, the CPU 91 determines whether the cover tag 6 is undetected by the wireless tag reader 80 or the cover tag 6 is located outside the first reading range R. Specifically, the CPU 91 determines whether the front cover 5 is moved to the open position in S1. When the cover tag 6 is undetected (S1: Yes), the CPU 91 proceeds to S2. When the cover tag 6 is detected and the front cover 5 is in the closed position (S1: No), the CPU 91 returns to S1.

In S2, the CPU 91 determines whether a drawer tag has changed from the detected state to the undetected state. In S2, the drawer tag includes both the first and second drawer tags 36A, 36B. In other words, the CPU 91 determines whether the drawer case 35 has started to move between the use position and the replacement position in S2. The movement of the drawer case 35 between the use position and the replacement position includes both movement from the use position to the replacement position and movement from the replacement position to the use position. When the drawer tag has changed from the detected state to the undetected state (S2: Yes), the CPU 91 proceeds to S3. When the drawer tag has not changed from the detected state to the undetected state (S2: No), the CPU 91 proceeds to S5.

In S3, the CPU 91 performs a second reading range setting process. In the second reading range setting process (S3), the CPU 91 sets the reading range of the wireless tag reader 80 to the second reading range L which is greater than the first reading range R. The second reading range L has a directivity toward the central portion of the opening 2A and includes the positions of the cartridge tags 45 when passing through the opening 2A (FIGS. 1 and 7). Specifically, the CPU 91 changes the intensity of radio waves including a command that the wireless tag reader 80 transmits, and sets the reading range of the wireless tag reader 80 to the second reading range L. After setting to the second reading range L, the CPU 91 proceeds to S4.

At the point in time when the drawer case 35 has started to move between the use position and the replacement position, the reading range of the wireless tag reader 80 is set to the second reading range L. The cartridge tags 45 pass within the second reading range L along with the movement of the drawer case 35 (FIG. 7). At this time, the wireless tag reader 80 reads information of the first to fourth cartridge tags 45K, 45Y, 45M, 45C. The CPU 91 stores the information read from the cartridge tags 45 in the EEPROM 94 in association with identification information of the respective cartridge tags 45.

In S4, the CPU 91 determines whether the wireless tag reader 80 has read information of all cartridge tags 45. When reading is completed (S4: Yes), the CPU 91 determines that all cartridge tags 45 are detected, and proceeds to S5. When reading is not completed (S4: No), the CPU 91 returns to S3. Thus, the reading range of the wireless tag reader 80 remains set to the second reading range L until the wireless tag reader 80 completes reading of information of all cartridge tags 45.

In S5, the CPU 91 executes a first reading range setting process. In the first reading range setting process (S5), the CPU 91 sets the reading range of the wireless tag reader 80 to the first reading range R. Specifically, the CPU 91 changes the intensity of radio waves including a command that the wireless tag reader 80 transmits, and sets the reading range of the wireless tag reader 80 to the first reading range R. After setting to the first reading range R, the CPU 91 returns to 51.

As described above, the laser printer 1 sets the reading range of the wireless tag reader 80 to the second reading range L only when the process cartridges 40 pass through the opening 2A along with the movement of the drawer case 35, by executing the reading range setting program. Thus, the laser printer 1 reliably allows the wireless tag reader 80 to read information of the cartridge tags 45. At other times, the laser printer 1 sets the reading range of the wireless tag reader 80 to the first reading range R. The first reading range R is set to detect the drawer tags 36A, 36B and the cover tag 6, and is narrower than the second reading range L. In other words, the laser printer 1 can detect the movements of the front cover 5 and the drawer case 35, while minimizing power consumption of the wireless tag reader 80.

The toner error handling program will be described with reference to FIG. 9.

This program is executed by the CPU 91 when a condition for a toner error (hereinafter referred to as toner error condition) is satisfied. A confirmation as to whether the toner error condition is satisfied is carried out at a predetermined time, e.g., at power-on, at the time when a predetermined number of sheets has been printed, and after the elapse of a predetermined time.

The toner error condition includes that the amount of toner remaining in a process cartridge 40 is smaller than a predetermined amount (hereinafter referred to as a toner empty condition) and that toner in a process cartridge 40 suffers deterioration (hereinafter referred to as a toner deterioration condition). The toner error condition is satisfied by either the toner empty condition or the toner deterioration condition, and the CPU 91 determines that a toner error occurs in the laser printer 1.

The toner empty condition is determined based on the number of recoding sheets P printed from a process cartridge 40 since the process cartridge 40 has been attached to the drawer case 35. When the number of recording sheets P printed from a process cartridge 40 exceeds a predetermined number, the CPU 91 determines that the process cartridge 40 satisfies the toner empty condition.

The toner deterioration condition is determined based on the elapsed time since the manufacture date of the process cartridge 40, the number of rotations of the photosensitive drum 31, and the number of recording sheets P printed from the process cartridge 40 since start of use. For example, the CPU 91 specifies the manufacture date of the process cartridge 40 from information obtained from its cartridge tag 45, and determines that the toner deterioration condition is satisfied when a period of time since the manufacture date until now is longer than a predetermined period of time.

When the toner error condition is satisfied, the CPU 91 sets a toner error flag in the RAM 93 in S11. The toner error flag means that a process cartridge 40 satisfies the toner error condition and that the toner error occurs in the laser printer 1. After setting the toner error flag, the CPU 91 proceeds to S12.

In S12, the CPU 91 executes an error information storage process. In the error information storage process (S12), the CPU 91 specifies a process cartridge 40 that satisfies the toner error condition (hereinafter referred to as a target process cartridge), and stores error information in the EEPROM 94 by associating the error information with identification information which has been obtained from a cartridge tag 45 of the target process cartridge 40. The error information indicates that the process cartridge 40 satisfies the toner error condition and that the error occurs in the process cartridge 40. When the error information storage process is finished, the CPU 91 proceeds to S13.

When the drawer case 35 holding the process cartridges 40 is moved from the replacement position to the use position, identification information of the cartridge tags 45 attached to the respective process cartridges 40 is read by the wireless tag reader 80 and stored in the EEPROM 94 in association with the process cartridges 40.

In S13, the CPU 91 executes a toner error notification process. In the toner error notification process (S13), the CPU 91 causes the display 95 to display messages indicating for example that a toner error occurs and that the target cartridge needs replacement. When the toner error notification process is finished, the CPU 91 proceeds to S14.

In S14, the CPU 91 determines whether cartridge replacement is completed. Specifically, the CPU 91 causes the wireless tag reader 80 to always detect the cover tag 6, the first drawer tag 36A, and the second drawer tag 36B. Thereby, the CPU 91 detects the movement of the front cover 5 to the open position, the movement of the drawer case 35 to the replacement position, the movement of the drawer case 35 to the use position, and the movement of the front cover 5 to the closed position, in this order and determines whether the cartridge replacement is completed. When the cartridge replacement is completed (S14: Yes), the CPU 91 proceeds to S15. When the cartridge replacement is not completed (S14: No), the CPU 91 returns to S13, and causes the display 95 to display a toner error.

In S15, the CPU 91 determines whether information of all cartridge tags 45 is obtained by the movement of the drawer case 35 during cartridge replacement. As described above, information of each cartridge tag 45 is read by the wireless tag reader 80 when each cartridge tag 45 passes through the second reading range L along with the movement of the drawer case 35, and the information is stored in the EEPROM 94. In S15, the CPU 91 determines whether the EEPROM 94 stores information of all cartridge tags 45. When the EEPROM 94 stores information of all cartridge tags 45 (S15: Yes), the CPU 91 proceeds to S16. When the EEPROM 94 does not store the information of all cartridge tags 45 (S15: No), the CPU 91 proceeds to S17.

In S16, the CPU 91 determines whether the target cartridge has been replaced with a new one. Specifically, the CPU 91 compares the information of the cartridge tag 45 of the target cartridge 40, which has been already stored in the EEPROM 94, with information of a cartridge tag 45 of a new cartridge 40, which is newly obtained during cartridge replacement. When the target cartridge has been replaced with a new one (S16: Yes), the CPU 91 proceeds to S18. When the target cartridge is not replaced (S16: No), the CPU 91 proceeds to S19.

In S17, the CPU 91 executes a reading error notification process. In the reading error notification process (S17), the CPU 91 causes the display 95 to display messages indicating for example that information of all cartridge tags 45 could not be read and that the drawer case 35 should be moved again between the use position and the replacement position. When the reading error notification process is finished, the CPU 91 returns to S15. The CPU 91 repeats S15 and S17 until information of all cartridge tags 45 is obtained.

In S18, the CPU 91 clears the toner error flag. By cleaning the toner error flag, the laser printer 1 is ready for image formation in normal operation. After clearing the flag, the CPU 91 finishes the toner error handling program.

In S19, the CPU 91 executes a cartridge error notification process. In the cartridge error notification process (S19), the CPU 91 causes the display 95 to display messages indicating for example that the target cartridge, which becomes a cause of a toner error, is not replaced with a new one. When the cartridge error notification process is finished, the CPU 91 returns to S14.

As described above, the laser printer 1 according to the first illustrative embodiment is provided with the wireless tag reader 80 in the vicinity of the upper end defining the opening 2A. The wireless tag reader 80 has the first reading range R and the second reading range L each having the directivity toward the central portion of the opening 2A. The laser printer 1 further includes the drawer case 35 that holds four process cartridges 40 therein. The drawer case 35 is configured to move through the opening 2A between the use position and the replacement position. Each process cartridge 40 is provided with a corresponding cartridge tag 45.

As shown in FIGS. 6-8, as the drawer case 35 moves between the use position and the replacement position, each process cartridge 40 moves together. At this time, the cartridge tag 45 attached to each process cartridge 40 passes within the second reading range L of the wireless tag reader 80. Thus, the laser printer 1 can obtain information of the first to fourth cartridge tags 45K-45C serially from one wireless tag reader 80.

In the laser printer 1, the cover tag 6, the first drawer tag 36A, the second drawer tag 36B and the cartridge tags 45 are wireless tags, e.g. passive RFID tags. Thus, the laser printer 1 is relatively inexpensive to manufacture.

The drawer case 35 is provided with the first drawer tag 36A and the second drawer tag 36B. When the drawer case 35 is attached to the main body 2, the first drawer tag 36A and the second drawer tag 36B are located above the first to fourth cartridge tags 45K-45C, under the wireless tag reader 80, and closer to the wireless tag reader 80 than the cartridge tags 45. In other words, when the drawer case 35 is placed in the use position or in the replacement position, the wireless tag reader 80 is disposed above the first drawer tag 36A and the second drawer tag 36B, and the first drawer tag 36A and the second drawer tag 36B are disposed above the first to fourth cartridge tags 45K-45C. Thus, when the drawer case 35 passes under the wireless tag reader 80, the wireless tag reader 80 reliably detects the first drawer tag 36A and the second drawer tag 36B, and thereby the laser printer 1 grasps the state of the drawer case 35 (as to whether the drawer case 35 is located in the use position or the replacement position).

The front cover 5 is provided with the cover tag 6. The cover tag 6 is located within the reading range of the wireless tag reader 80 when the front cover 5 is in the closed position.

Thus, as the wireless tag reader 80 detects the cover tag 6, and thereby the laser printer 1 detects the position of the front cover 5.

The laser printer 1 sets the reading range of the wireless tag reader 80 in response to the position of the drawer case 35, which moves between the use position and the replacement position, by executing the reading range setting program. With this program, the wireless tag reader 80 reliably reads information of target wireless tags that are the cover tag 6, the first and second drawer tags 36A and 36B, and the cartridge tags 45, and the laser printer 1 minimizes power consumption required for reading information.

The cartridge tags 45 of the first illustrative embodiment have antennas 46 of the same shape. Thus, as the same type of wireless tags can be used in the laser printer 1, the cost of the cartridge tags 45 can be minimized. In addition, the cartridge tags 45 are disposed such that a distance between the wireless tag reader 80 and each cartridge tag 45 located within the reading range is different among the process cartridges 40. Thus, the laser printer 1 can distinguish the cartridge tags 45 and the process cartridges 40 in response to the intensity of radio waves from each of the cartridge tags 45.

A second illustrative embodiment will be described with reference to FIGS. 10 and 11. The second illustrative embodiment of the disclosure also applies to the laser printer 1.

The laser printer 1 of the second illustrative embodiment is identical in structure to that of the first illustrative embodiment. The reading range setting program and the toner error handling program of the second illustrative embodiment are the same as those of the first illustrative embodiment, and thus descriptions thereof will be omitted.

The second illustrative embodiment is different from the first illustrative embodiment in structure and arrangement of the cartridge tags 45 attached to the process cartridges 40. The second illustrative embodiment will mainly describe the cartridge tags 45.

The cartridge tags 45 of the second illustrative embodiment are disposed in predetermined positions on the top surfaces of the respective cartridges 40. As is the case with the first illustrative embodiment, the cartridge tags 45 are wireless tags, e.g. passive RFID tags, and each have an antenna 46 and an IC chip 47. In addition, each cartridge tag 45 contains identification information.

Figure 10:
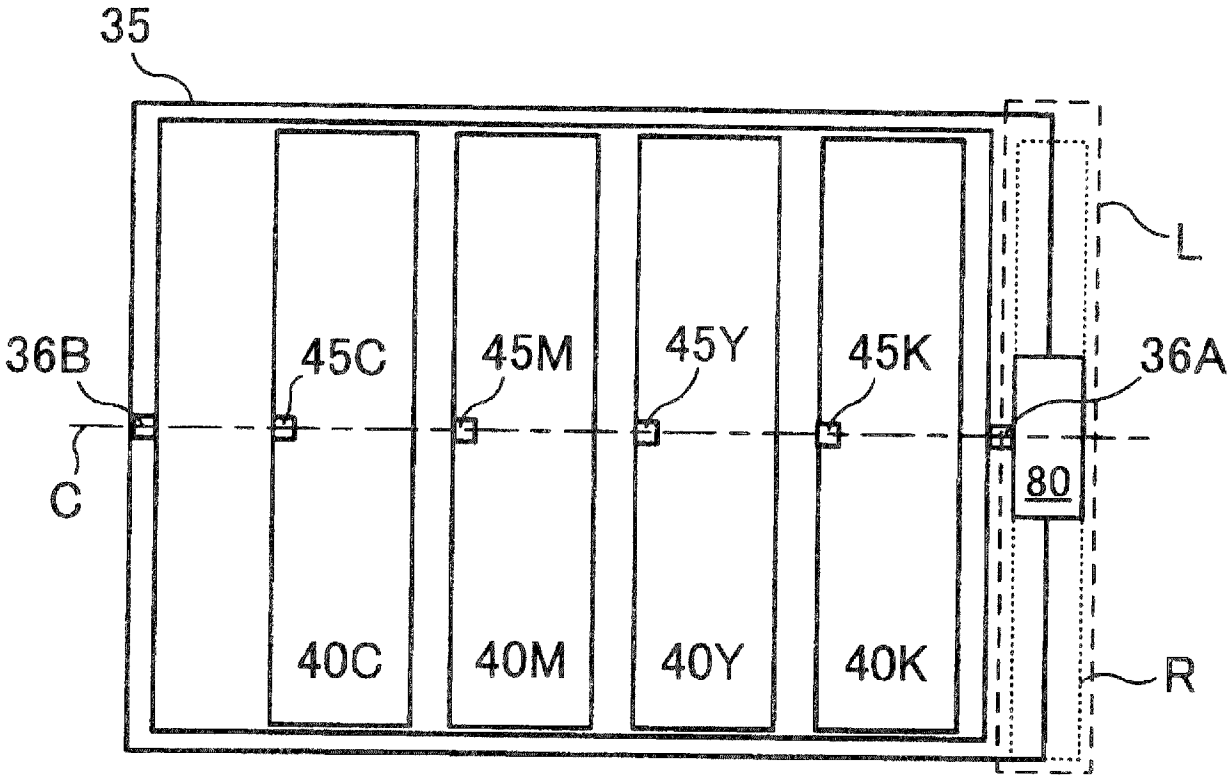
FIG. 10 is a top view schematically illustrating an arrangement of cartridge tags according to a second illustrative embodiment.

As shown in FIG. 10, the first cartridge tag 45K, the second cartridge tag 45Y, the third cartridge tag 45M, and the fourth cartridge tag 45C are located on the centerline C of the drawer case 35 in the width direction. Thus, when the drawer case 35 is moved between the use position and the replacement position, the first to fourth cartridge tags 45K, 45Y, 45M, and 45C pass directly below the wireless tag reader 80.

Figure 11A:
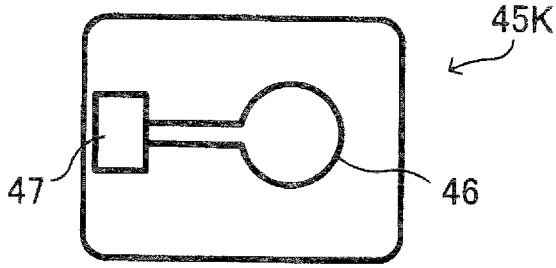
FIGS. 11A to 11D illustrate structures of the cartridge tags according to the second illustrative embodiment.
Figure 11B:
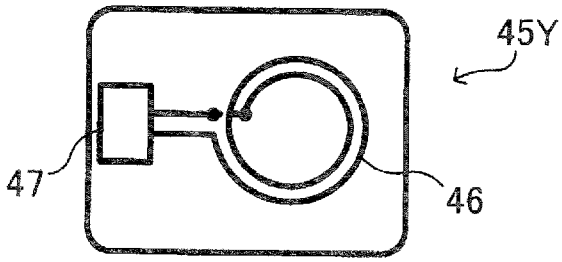
Figure 11C:
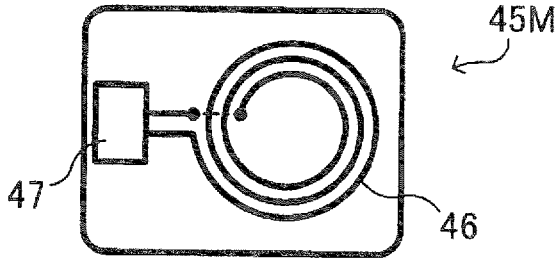
Figure 11D:
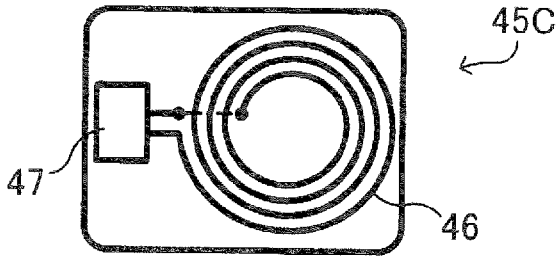

The cartridges 45 of the second illustrative embodiment have antennas 46 which are different in shape. As shown in FIG. 11A, the antenna 46 of the first cartridge tag 45K is a loop antenna. As shown in FIGS. 11B, 11C, and 11D, the antennas 46 of the second to fourth cartridge tags 45Y, 45M, and 45C are spiral antennas having different number of turns.

As described above, the wireless tag reader 80 reads information stored in the wireless tags by transmitting and receiving radio waves to and from the wireless tags. The cartridge tags 45 are equal in distance from the wireless tag reader 80 when passing under the wireless tag reader 80 and different in shape of the antennas 46. Thus, the radio waves transmitted from the cartridge tags 45 reach the wireless tag reader 80 with different intensities, and the wireless tag reader 80 can identify each cartridge tag 45 with the intensity of the radio waves the wireless tag reader 80 receives.

As described above, the laser printer 1 of the second illustrative embodiment can produce effects similar to those brought about by the laser printer 1 of the first illustrative embodiment. In the laser printer 1 of the second illustrative embodiment, each cartridge tag 45 is located in a predetermined position of the corresponding process cartridge 40. Thus, the laser printer 1 of the second illustrative embodiment can improve the workability in attachment of the cartridge tags 45 to the respective process cartridges 40. Each cartridge tag 45 contains an antenna having a different number of turns. Thus, the laser printer 1 of the second illustrative embodiment can distinguish the cartridge tags 45 and the process cartridges 40 in response to the intensity of radio waves transmitted from each cartridge tag 45.

The above illustrative embodiments show, but are not limited to, that the cover tag 6, the drawer tags 36A, 36B, the cartridge tags 45 are wireless tags, e.g. passive RFID tags. Active and semi-passive RFID tags may be used instead of the passive RFID tags.

In the toner error handling program, a determination is made as to whether the target cartridge, which is a cause of a toner error, has been replaced with a new one and then the cartridge error notification process (S19) is executed. However, the disclosure is not limited to this embodiment. For example, the toner error handling program may proceed as follows: each cartridge tag 45 may store information regarding a toner color of the corresponding process cartridge 40 to which the cartridge tag 45 is attached, and a determination may be made as to whether each process cartridge 40 is disposed in a predetermined position in the drawer case 35. The laser printer 1 is configured to obtain information of each cartridge tag 45 from the movement of the drawer case 35 and to find the position of each process cartridge 40 in the drawer case 35 based on the information regarding the toner color. In this case, it is preferable that, if the process cartridge 40 is incorrectly disposed in the drawer case 35, such a message is displayed on the display 95.

The first illustrative embodiment shows, but is not limited to, that the antennas 46 of the cartridge tags 45 are loop antennas identical in shape. The antennas 46 may be formed in any shape, e.g., spiral antennas and helical antennas, as long as they are identical in shape. In addition, the cartridge tags 45 may be located in any positions on the process cartridges 40 as long as a distance between the wireless tag reader 80 and each process cartridge 45 passing under the wireless tag reader 80 is different.

In the second illustrative embodiment, the antennas 46 of the cartridge tags 45 are loop antenna and spiral antennas having different number of turns. However, the antennas 46 may be configured only with the same type of antennas, e.g., spiral antennas or helical antennas, as long as the number of turns differs among the antennas 46. In addition, the cartridge tags 45 may be located in any position on the process cartridges 40 as long as the distance between each cartridge tag 45 and the wireless tag reader 80 is equal.

This illustrative embodiment shows, but is not limited to, the direct-tandem type color laser printer. It will be appreciated that this illustrative embodiment also applies to other types of image forming apparatuses, an intermediate transfer type color laser printer, four-cycle color laser printer, and monochrome printer as well. In addition, development may be performed with not only single component development method but also two-component development method.

While the features herein have been described in connection with various example structures and illustrative aspects, it will be understood by those skilled in the art that other variations and modifications of the structures and aspects described above may be made without departing from the scope of the disclosures described herein. Other structures and aspects will be apparent to those skilled in the art from a consideration of the specification or practice of the features disclosed herein. It is intended that the specification and the described examples only are illustrative with the true scope of the disclosures being defined by the following claims.

What is claimed is:

1. An image forming apparatus configured to form an image on a recording sheet, comprising:

a main body having an opening;

a cover configured to move between an open position where the opening of the main body is open and a closed position where the opening of the main body is closed;

a consumable unit accommodating a consumable used for image formation, the consumable unit including a first wireless tag that stores information;

an accommodating unit configured to detachably accommodate the consumable unit including the first wireless tag, the accommodating unit being configured to move through the opening of the main body between a first position where the accommodating unit is in the main body and a second position where the accommodating unit is outside the main body; and a wireless tag reader disposed in the main body and configured to read the information of the first wireless tag located in a reading range, wherein the accommodating unit is configured to move such that the first wireless tag of the consumable unit accommodated in the accommodating unit passes through the reading range when the accommodating unit moves through the opening of the main body between the first position and the second position, wherein the wireless tag reader is configured to read the information of the first wireless tag passing through a specified position in the reading range and away from the wireless tag reader when the accommodating unit accommodating the consumable unit moves through the opening of the main body between the first position and the second position, wherein the accommodating unit includes a second wireless tag that stores information to be read by the wireless tag reader, wherein the wireless tag reader is configured to, when the cover moves from the open position to the closed position, set the reading range to a first reading range which includes a position of the second wireless tag, wherein the wireless tag reader is configured to, when the cover moves from the closed position to the open position, set the reading range to a second reading range which includes a position of the first wireless tag moving along with the accommodating unit, and wherein the first reading range is smaller than the second reading range.

2. The image forming apparatus according to claim 1, wherein the wireless tag reader is configured to transmit radio waves including a reading command within the reading range and to receive radio waves including the information stored in the first wireless tag that is located in the reading range and receives the radio waves including the reading command, such that the wireless tag reader reads the information stored in the first wireless tag.

3. The image forming apparatus according to claim 1, wherein the accommodating unit includes a third wireless tag disposed in a position included in the reading range of the wireless tag reader when the accommodating unit is located in the second position.

4. The image forming apparatus according to claim 1, wherein the second wireless tag is disposed in such a position that a distance between the wireless tag reader and the second wireless tag located in the reading range is shorter than a distance between the wireless tag reader and the first wireless tag located in the reading range.

5. The image forming apparatus according to claim 1, wherein the cover includes a third wireless tag disposed in a position included in the first reading range of the wireless tag reader when the cover is in the closed position.

6. The image forming apparatus according to claim 5, wherein the wireless tag reader is disposed above the third wireless tag when the cover is in the closed position.

7. The image forming apparatus according to claim 1, wherein when the accommodating unit is in the first position, the wireless tag reader is disposed above the second wireless tag, and the second wireless tag is disposed above the first wireless tag.

8. An image forming apparatus configured to form an image on a recording sheet, comprising:

a main body having an opening;

a cover configured to move between an open position where the opening of the main body is open and a closed position where the opening of the main body is closed;

a plurality of consumable units accommodating consumables used for image formation respectively, the consumable units including respective first wireless tags, each of the first wireless tags storing information;

an accommodating unit configured to detachably accommodate the consumable units arranged in an arrangement direction and including the first wireless tags, the accommodating unit being configured to move through the opening of the main body along the arrangement direction and between a first position where the accommodating unit is in the main body and a second position where the accommodating unit is outside the main body; and a wireless tag reader disposed in the main body and configured to read the information of the first wireless tags located in a reading range, wherein the accommodating unit is configured to move such that the first wireless tags of the consumable units accommodated in the accommodating unit pass through the reading range when the accommodating unit moves through the opening of the main body between the first position and the second position, wherein the wireless tag reader is configured to read the information of the first wireless tags passing through a specified position in the reading range and away from the wireless tag reader when the accommodating unit accommodating the consumable units moves through the opening of the main body between the first position and the second position, wherein the accommodating unit includes a second wireless tag that stores information to be read by the wireless tag reader, wherein the wireless tag reader is configured to, when the cover moves from the open position to the closed position, set the reading range to a first reading range which includes a position of the second wireless tag, wherein the wireless tag reader is configured to, when the cover moves from the closed position to the open position, set the reading range to a second reading range which includes a position of each of the first wireless tags moving along with the accommodating unit, and wherein the first reading range is smaller than the second reading range.

9. The image forming apparatus according to claim 8, wherein the wireless tag reader is configured to transmit radio waves including a reading command within the reading range and to receive radio waves including the information stored in each of the first wireless tags that is located in the reading range and receives the radio waves including the reading command, such that the wireless tag reader reads the information stored in each of the first wireless tags.

10. The image forming apparatus according to claim 9, wherein:

the first wireless tags include respective antennas that are identical in shape, the antennas are configured to exchange radio waves with the wireless tag reader, and the first wireless tags are attached to the respective consumable units such that a distance between each wireless tag located in the reading range and the wireless tag reader is different.

11. The image forming apparatus according to claim 9, wherein:

the first wireless tags include respective antennas, each having a different number of turns, the antennas are configured to exchange radio waves with the wireless tag reader, and the first wireless tags are attached to the respective consumable units such that a distance between each wireless tag located in the reading range and the wireless tag reader is equal.

12. The image forming apparatus according to claim 8, wherein the accommodating unit includes a third wireless tag disposed in a position included in the reading range of the wireless tag reader when the accommodating unit is located in the second position.

13. The image forming apparatus according to claim 8, wherein the second wireless tag is disposed in such a position that a distance between the wireless tag reader and the second wireless tag located in the reading range is shorter than a distance between the wireless tag reader and each of the first wireless tags located in the reading range.

14. The image forming apparatus according to claim 8, wherein the cover includes a third wireless tag disposed in a position included in the reading range of the wireless tag reader when the cover is in the closed position.

15. An image forming apparatus configured to form an image on a recording sheet, comprising:

a main body having an opening;

a cover configured to move between an open position where the opening of the main body is open and a closed position where the opening of the main body is closed; and a wireless tag reader disposed in the main body, the wireless tag reader being configured to read information stored in a wireless tag wherein the wireless tag reader is configured to, when the cover is in the closed position, read information, stored in a first wireless tag, in a first mode having a first reading range, and wherein the wireless tag reader is configured to, when the cover is in the open position, change the first mode to a second mode having a second reading range, which is different in size from the first reading range, to read information, stored in a second wireless tag, in the second mode having the second reading range.

16. The image forming apparatus according to claim 15, wherein the second reading range is greater in size than the first reading range.

17. The image forming apparatus according to claim 15, wherein the cover includes the first wireless tag disposed in a position included in the first reading range when the cover is in the closed position.

18. The image forming apparatus according to claim 15, further comprising:

a consumable unit accommodating a consumable used for image formation, the consumable unit including the second wireless tag; and an accommodating unit configured to detachably accommodate the consumable unit including the second wireless tag, the accommodating unit being configured to move through the opening of the main body between a first position in which the accommodating unit is in the main body and a second position in which the accommodating unit is outside the main body, wherein the wireless tag reader is configured to, when the cover is in the open position, read, in the second mode having the second reading range, the information stored in the second wireless tag of the consumable unit accommodated in the accommodating unit moving through the opening of the main body between the first position and the second position.

19. The image forming apparatus according to claim 15, further comprising an accommodating unit configured to detachably accommodate a consumable unit accommodating a consumable used for image formation, the accommodating unit being configured to move through the opening of the main body between a first position in which the accommodating unit is in the main body and a second position in which the accommodating unit is outside the main body, wherein the cover includes the first wireless tag, wherein the accommodating unit includes a third wireless tag that stores information, and wherein the wireless tag reader is configured to, when the cover is in the closed position, read, in the first mode having the first reading range, the information stored in the first wireless tag of the cover and the information stored in the third wireless tag of the accommodating unit.

20. The image forming apparatus according to claim 15, wherein the wireless tag reader is configured to, when the cover is in the closed position, transmit radio waves including a reading command within the first reading range, and receive radio waves including the information stored in the first wireless tag from the first wireless tag, which is located in the first reading range and receives the radio waves including the reading command transmitted by the wireless tag reader, such that the wireless tag reader reads the information stored in the first wireless tag, and wherein the wireless tag reader is configured to, when the cover is in the open position, transmit radio waves including a reading command within the second reading range, and receive radio waves including the information stored in the second wireless tag from the second wireless tag, which is located in the second reading range and receives the radio waves including the reading command transmitted by the wireless tag reader, such that the wireless tag reader reads the information stored in the second wireless tag.

* * * * *